US010512377B2

(12) United States Patent
Williams

(10) Patent No.: US 10,512,377 B2
(45) Date of Patent: Dec. 24, 2019

(54) UPRIGHT VACUUM CLEANER INCLUDING MAGNETS

(71) Applicant: Emerson Electric Co., St. Louis, MO (US)

(72) Inventor: Matthew A. Williams, Bridgeton, MO (US)

(73) Assignee: Emerson Electric Co., St. Louis, MO (US)

( * ) Notice: Subject to any disclaimer, the term of this patent is extended or adjusted under 35 U.S.C. 154(b) by 295 days.

(21) Appl. No.: 15/620,108

(22) Filed: Jun. 12, 2017

(65) Prior Publication Data

US 2018/0353024 A1 Dec. 13, 2018

(51) Int. Cl.

| | |
|---|---|
| ***A47L 5/30*** | (2006.01) |
| ***A47L 9/04*** | (2006.01) |
| ***A47L 9/28*** | (2006.01) |
| ***A47L 9/32*** | (2006.01) |

(52) U.S. Cl.

CPC ..... *A47L 5/30* (2013.01); *A47L 9/0411* (2013.01); *A47L 9/0444* (2013.01); *A47L 9/0477* (2013.01); *A47L 9/2857* (2013.01); *A47L 9/2878* (2013.01); *A47L 9/325* (2013.01)

(58) Field of Classification Search

None

See application file for complete search history.

(56) References Cited

U.S. PATENT DOCUMENTS

| | | | |
|---|---|---|---|
| 2,288,115 | A | 6/1942 | Soldanels |
| 2,677,461 | A | 5/1954 | Bodey |
| 2,847,084 | A | 8/1958 | Wolfskill et al. |
| 2,862,224 | A | 12/1958 | Swanson et al. |
| 4,006,512 | A | 2/1977 | Saulson |
| 4,279,745 | A | 7/1981 | Haase |
| 4,300,260 | A | 11/1981 | Hill |
| 4,598,439 | A | 7/1986 | Good |
| 4,759,095 | A | 7/1988 | Hoy, Jr. |
| 5,052,074 | A | 10/1991 | Korsen |
| 5,179,756 | A | 1/1993 | Korsen |
| 5,271,119 | A | 12/1993 | Myers et al. |

(Continued)

FOREIGN PATENT DOCUMENTS

| | | | |
|---|---|---|---|
| JP | H02305533 | A | 12/1990 |

*Primary Examiner* — Andrew A Horton

(74) *Attorney, Agent, or Firm* — Armstrong Teasdale LLP

(57) ABSTRACT

An upright vacuum cleaner includes a blower for pulling air and debris through the upright vacuum cleaner, a motor connected to the blower, and a cleaning head for removing the debris from a floor. The cleaning head includes a front wall, a rear wall, a first sidewall, and a second sidewall. The first sidewall and the second sidewall extend between the front wall and rear wall. The vacuum cleaner further includes a debris tube connected to the cleaning head for receiving the debris from the cleaning head. The vacuum cleaner also includes magnet assemblies adapted to prevent metal objects from entering the cleaning head. Each magnet assembly includes a bracket and a magnet. The bracket includes a horizontal plate and a vertical plate. The magnet is connected to the vertical plate. The front wall includes shelves to support the magnet assemblies. Each shelf is arranged to receive one of the magnet assemblies such that the horizontal plate rests on the shelf and the magnet is positioned below the shelf.

20 Claims, 8 Drawing Sheets

(56) References Cited

U.S. PATENT DOCUMENTS

| | | | | |
|---|---|---|---|---|
| 6,341,403 | B1 | 1/2002 | Strickrodt et al. | |
| D470,401 | S | 2/2003 | Genoa et al. | |
| D545,512 | S | 6/2007 | Genoa et al. | |
| 7,377,006 | B2 | 5/2008 | Genoa et al. | |
| 7,533,440 | B2 | 5/2009 | Paterson et al. | |
| D653,414 | S | 1/2012 | Genoa et al. | |
| D693,531 | S | 11/2013 | Genoa et al. | |
| 8,667,644 | B1 * | 3/2014 | Marion | A47L 9/02 15/360 |
| 2005/0217063 | A1 | 10/2005 | Paterson et al. | |
| 2006/0174440 | A1 | 8/2006 | Genoa et al. | |
| 2006/0174441 | A1 | 8/2006 | Genoa et al. | |
| 2006/0174442 | A1 | 8/2006 | Genoa et al. | |
| 2007/0074368 | A1 | 4/2007 | Genoa et al. | |

* cited by examiner

UPRIGHT VACUUM CLEANER INCLUDING MAGNETS

FIELD

The field relates to vacuum cleaners and, in particular, upright vacuum cleaners that include magnet assemblies to prevent metal objects from being vacuumed.

BACKGROUND

Vacuum cleaners typically include a cleaning head and a debris tube connected to the cleaning head. Some known vacuum cleaners include a rotary brush in the cleaning head that rotates to entrain debris into an airflow through the cleaning head. During operation of the vacuum cleaner, some debris may damage the vacuum cleaner if the debris is drawn into the cleaning head. In particular, metal objects such as staples and paperclips, may become lodged in, abrade, and damage internal components of the vacuum cleaner. In addition, such debris may be propelled by the rotary brush and damage the cleaner. Some vacuum cleaners include guards that extend from the cleaning head to prevent unwanted objects from being drawn into the cleaning head. Such guards may be part of the original vacuum design, or added to the vacuum cleaner by the purchaser as an add-on or modification to the original design. However, such guards may increase the cost to assemble and operate the vacuum cleaners. In addition, the guards may increase the footprint of the vacuum cleaner and affect the maneuverability and aesthetics of the vacuum cleaner. Moreover, at least some of the prior art guards are difficult to attach and/or remove from the vacuum cleaner.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, an upright vacuum cleaner includes a blower for pulling air and debris through the upright vacuum cleaner, a motor connected to the blower, and a cleaning head for removing the debris from a floor. The cleaning head includes a front wall, a rear wall, a first sidewall, and a second sidewall. The first sidewall and the second sidewall extend between the front wall and rear wall. The vacuum cleaner further includes a debris tube connected to the cleaning head for receiving the debris from the cleaning head. The vacuum cleaner also includes magnet assemblies adapted to prevent metal objects from entering the cleaning head. Each magnet assembly includes a bracket and a magnet. The bracket includes a horizontal plate and a vertical plate. The magnet is connected to the vertical plate. The front wall includes shelves to support the magnet assemblies. Each shelf is arranged to receive one of the magnet assemblies such that the horizontal plate rests on the shelf and the magnet is positioned below the shelf.

In another aspect, a method of assembling a vacuum cleaner includes removing a bumper from a front wall of a cleaning head of the vacuum cleaner to expose recesses in the front wall. The vacuum cleaner includes magnet assemblies. The method also includes positioning each of the magnet assemblies in a respective one of the recesses. Each magnet assembly includes a bracket and a magnet. The bracket includes a horizontal plate and a vertical plate. The magnet is connected to the vertical plate. The method further includes positioning the horizontal plate of each magnet assembly on a shelf within the respective recess. Each shelf is arranged to receive one of the magnet assemblies such that the horizontal plate rests on the shelf and the magnet is positioned below the shelf. The method also includes attaching the bumper to the front wall such that the bumper covers the recesses.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
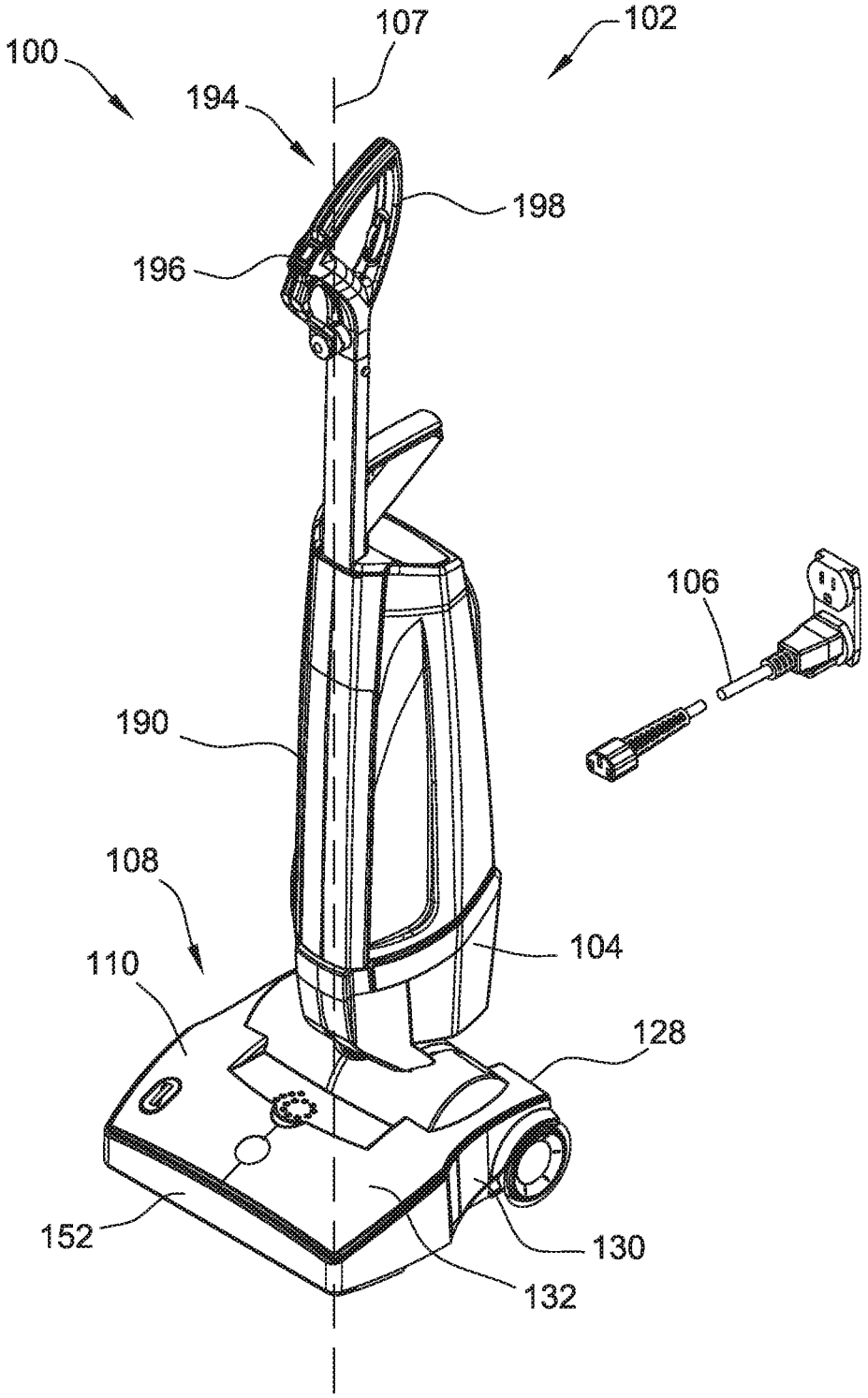
FIG. 1 is a perspective view of a vacuum cleaning system including a vacuum cleaner.

FIG. 1 is a perspective view of an example vacuum cleaning system 100. Vacuum cleaning system 100 includes a vacuum cleaner 102, a battery 104, and a power cord 106. Vacuum cleaner 102 may be connected to and receive power from battery 104 or power cord 106. Accordingly, vacuum cleaner 102 may be operated in a cordless mode and a corded mode. In other embodiments, vacuum cleaner 102 may have any configuration that enables vacuum cleaner 102 to operate as described.

Directions indicated herein refer to the orientation of vacuum cleaner 102 shown in FIG. 1 unless stated otherwise. For example, the term "vertical" refers to a direction parallel to a longitudinal axis 107 of vacuum cleaner 102. The term "horizontal" refers to a direction perpendicular to longitudinal axis 107.

Figure 2:
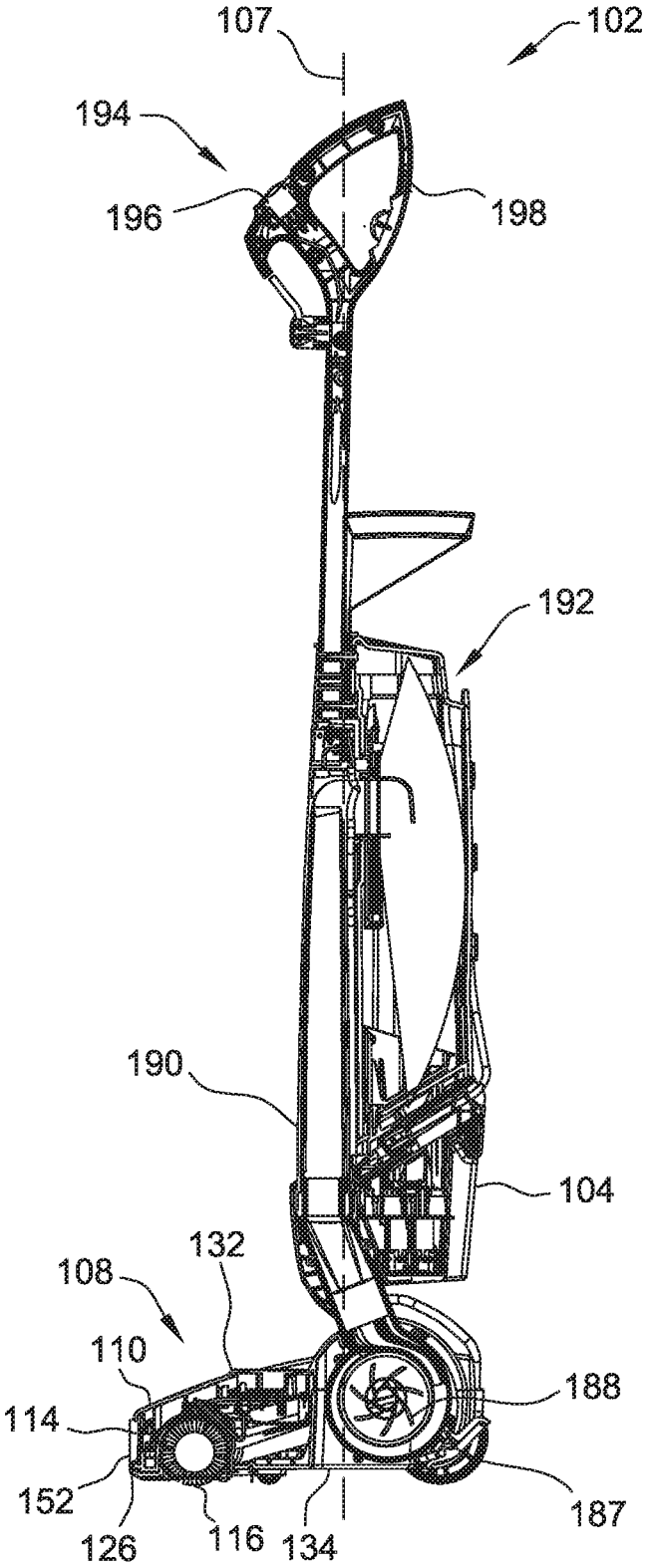
FIG. 2 is a sectional side view of the vacuum cleaner.
Figure 3:
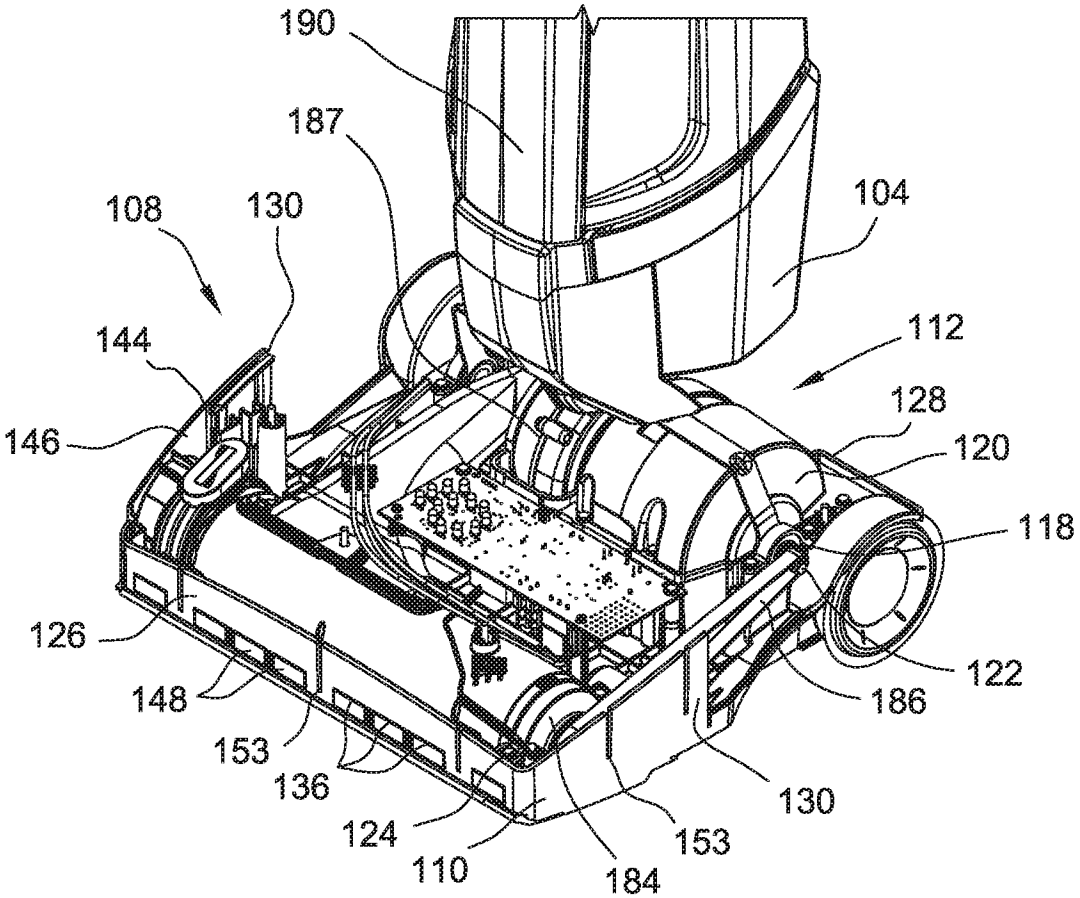
FIG. 3 is a perspective view of a cleaning head of the vacuum cleaner with a cover removed.

Referring to FIGS. 2-3, vacuum cleaner 102 includes a cleaning head 108 for removing debris from a floor and directing the debris into vacuum cleaner 102. Cleaning head 108 includes a housing 110, a motor assembly 112, and a rotary brush 114. Housing 110 at least partially covers motor assembly 112 and rotary brush 114. Motor assembly 112 powers rotary brush 114 that includes one or more brushes 116 that rotate and may contact the floor to agitate debris and promote entrainment of the debris into airflow through vacuum cleaner 102. Motor assembly 112 includes a motor 118, a motor housing 120, and a rotatable drive shaft 122. Drive shaft 122 of motor assembly 112 is operatively connected to rotary brush 114 by a pulley assembly 124. In other embodiments, cleaning head 108 may have any configuration that enables vacuum cleaner 102 to operate as described.

Pulley assembly 124 may include a clutch 184 and a belt 186. Clutch 184 is connected to rotary brush 114. Belt 186 extends between clutch 184 and drive shaft 122 to connect clutch 184 to motor 118. During operation of motor 118, clutch 184 is rotated by belt 186 at a first speed and clutch 184 rotates rotary brush 114 at a second speed such that rotary brush 114 agitates debris. In other embodiments, vacuum cleaner 102 may include any pulley assembly 124 that enables vacuum cleaner 102 to operate as described. For example, in some embodiments, clutch 184 is omitted.

A blower or fan 188 pulls air and debris from rotary brush 114, through a blower housing 187 and into blower 188. Blower 188 is connected to motor 118 on a side opposite pulley assembly 124. Blower 188 pushes the air and debris into a debris tube 190 that extends upward from cleaning head 108. Debris tube 190 is pivotally attached to cleaning head 108. Air and debris travel up debris tube 190 and are discharged into a filter assembly 192, where debris is filtered from the air and collected.

In reference to FIGS. 1 and 2, a handle assembly 194 is attached to debris tube 190. Handle assembly 194 extends vertically from debris tube 190 along longitudinal axis 107 of vacuum cleaner 102. Handle assembly 194 includes a power switch 196 and a handle 198. Power switch 196 is attached to handle 198 and is positionable between an ON position and an OFF position to control power to vacuum cleaner 102. In other embodiments, vacuum cleaner 102 may include any components that enable vacuum cleaner 102 to operate as described.

In addition, with reference to FIG. 3, cleaning head 108 includes magnet assemblies 148 to collect magnetic and/or magnetizable objects in the debris and prevent such objects from entering the cleaning head 108. Accordingly, magnet assemblies 148 prevent damage to components along the debris flow path within vacuum cleaner 102, such as blower 188. In addition, magnet assemblies 148 prevent metal objects being projected from vacuum cleaner 102 by rotary components such as rotary brush 114. As described below, magnet assemblies 148 are removably attached to housing 110.

Magnet assemblies 148 reduce the time to assemble vacuum cleaner 102 because magnet assemblies 148 are simpler to secure to cleaning head 108 that at least some known magnets. In addition, magnet assemblies 148 are positioned within front wall 126 and do not extend outward from cleaning head 108 when magnet assemblies are attached to front wall 126. As a result, magnet assemblies 148 allow vacuum cleaner 102 to have a smooth aesthetic appearance and do not hinder the maneuverability of vacuum cleaner 102.

Housing 110 includes a front wall 126, a rear wall 128, sidewalls 130, a top cover 132 (shown in FIG. 1), and a bottom cover 134 (shown in FIG. 2). Sidewalls 130 extend between front wall 126 and rear wall 128. Top cover 132 and bottom cover 134 are attached to front wall 126, rear wall 128, and sidewalls 130 on opposite sides. In alternative embodiments, cleaning head 108 may include any housing 110 that enables vacuum cleaner 102 to operate as described.

In reference to FIGS. 2 and 3, rotary brush 114 is positioned in cleaning head 108 between sidewalls 130. Brushes 116 extend from rotary brush 114 and contact debris during operation of vacuum cleaner 102. In this embodiment, sidewall 130 defines an opening 144. A removable panel 146 is attached to sidewall 130 and covers opening 144. When removable panel 146 is detached from sidewall 130, rotary brush 114 may be removed from cleaning head 108 through opening 144.

Figure 4:
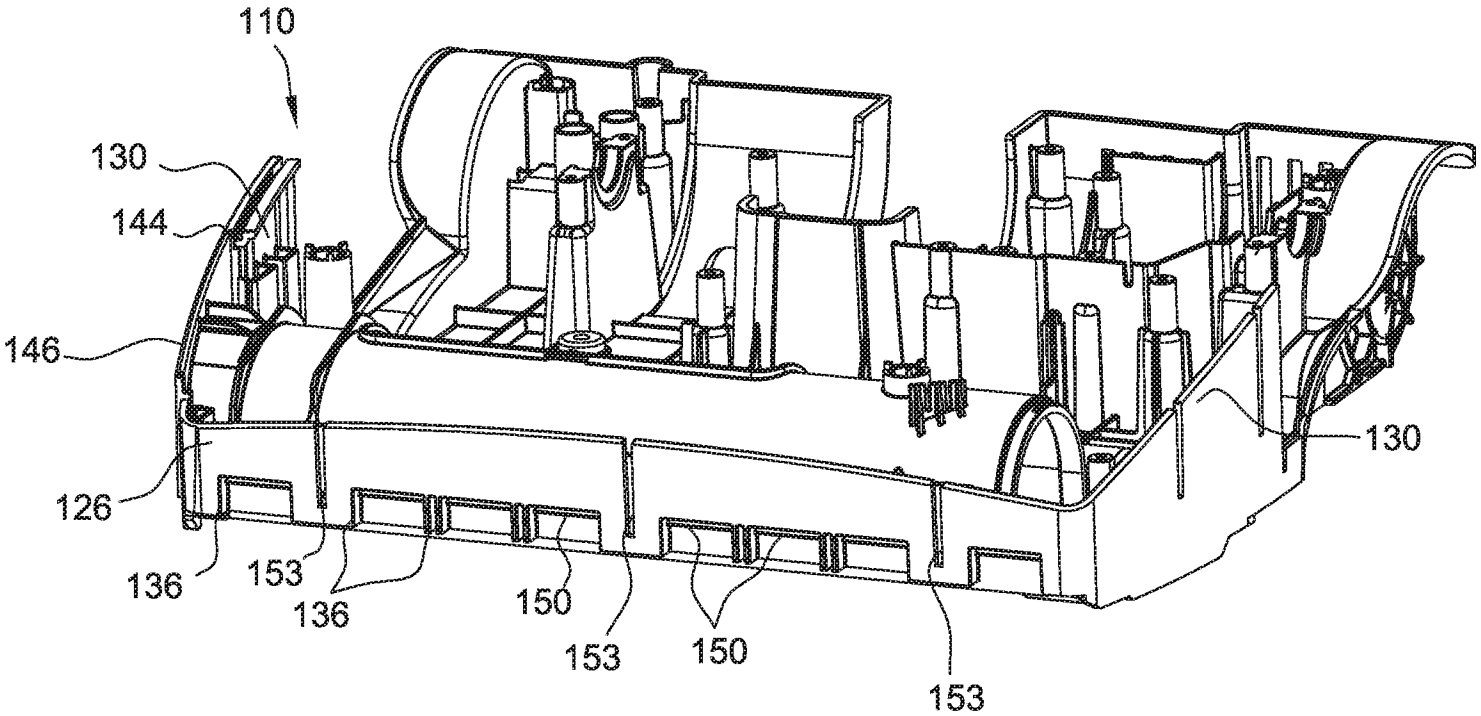
FIG. 4 is a front perspective view of a portion of a housing for the cleaning head.

As shown in FIG. 4, front wall 126 includes recesses 136 and shelves 150. Recesses 136 receive magnet assemblies 148 (shown in FIG. 3) and shelves 150 secure magnet assemblies 148 in recesses 136. Recesses 136 are spaced along front wall 126. In this embodiment, cleaning head 108 includes eight recesses 136. In other embodiments, cleaning head 108 may include any number of recesses 136 that enable vacuum cleaner 102 to operate as described.

As shown in FIG. 1, a bumper 152 removably connects to cleaning head 108 and covers recesses 136 (shown in FIG. 4). With reference to FIGS. 1 and 4, bumper 152 extends along front wall 126 and partially along sidewalls 130. A portion of bumper 152 is received within slots 153 in front wall 126 and sidewalls 130 to secure bumper 152 to cleaning head 108. Bumper 152 may help to retain magnet assemblies 148 (shown in FIG. 3) in recesses 136 when bumper 152 is attached to cleaning head 108. In particular, bumper 152 contacts magnet assemblies 148 and causes magnet assemblies 148 to contact front wall 126. Bumper 152 may be removed from cleaning head 108 to expose recesses 136 and allow magnet assemblies 148 to be attached to or removed from cleaning head 108. In some embodiments, bumper 152 may be constructed of an elastic material and absorb shocks when vacuum cleaner 102 contacts objects. In other embodiments, vacuum cleaner 102 may include any bumper 152 that enables vacuum cleaner 102 to operate as described.

Figure 5:
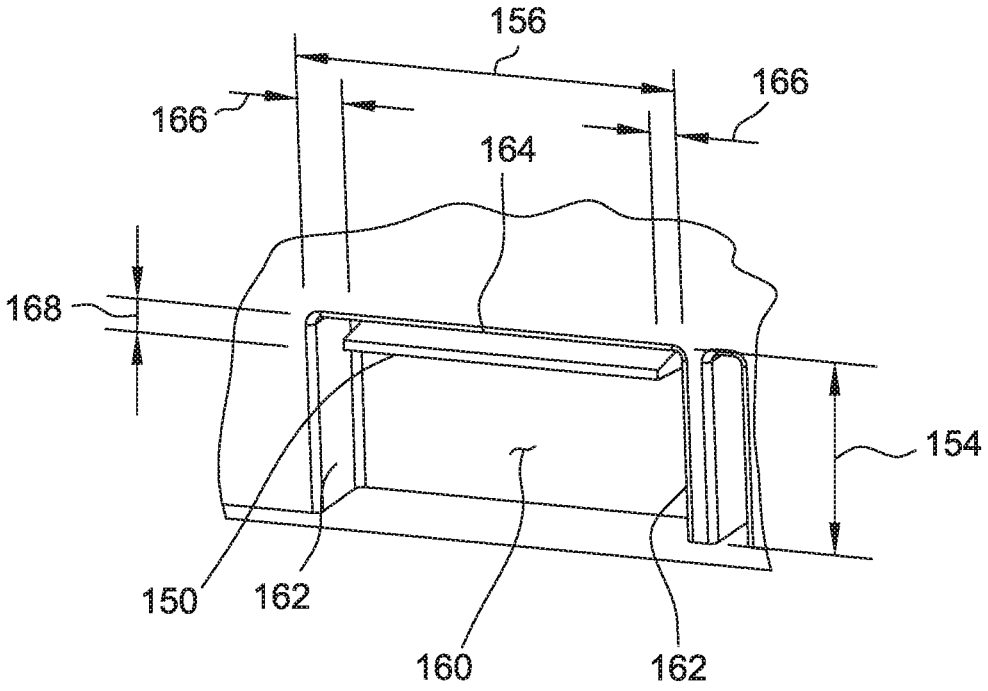
FIG. 5 is an enlarged front view of a recess in the housing.
Figure 8:
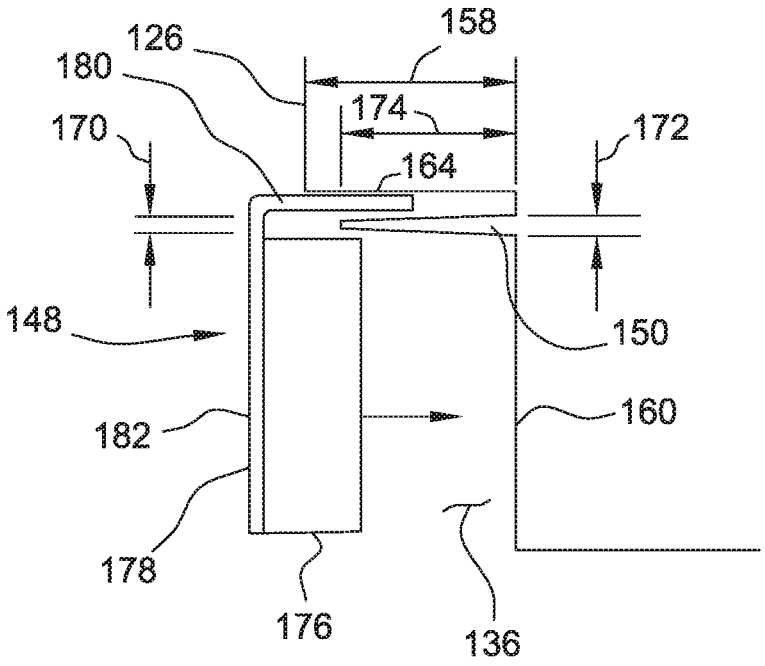
FIG. 8 is a sectional schematic view of the magnet assembly attached to a shelf within the recess.

Referring to FIGS. 5 and 8, recesses 136 have a height 154, a length 156, and a depth 158. For example, height 154 is suitably in a range of about 6 millimeters (mm) (0.25 inches (in.)) to about 25 mm (1 in.). Length 156 is suitably in a range of about 13 mm (0.5 in.) to about 102 mm (4 in.). Depth 158 is suitably in a range of about 5 mm (0.1875 in.) to about 19 mm (0.75 in.). In other embodiments, recesses 136 may have any height 154, length 156, and depth 158 that enable recesses 136 to function as described.

Each recess 136 is defined by a rear surface 160, side surfaces 162, and an upper surface 164. In other embodiments, each recess 136 may be defined by a lower surface (not shown) that is positioned opposite the upper surface 164. Shelves 150 extend from rear surface 160 within recesses 136. In this embodiment, recesses 136 are slightly wider than shelves 150 such that gaps 166 are defined between ends of shelves 150 and side surfaces 162. Gaps 166 are suitably in a range of about 0.1 mm (0.004 in.) to about 5 mm (0.20 in.). In addition, shelves 150 are spaced a distance 168 from upper surface 164. Distance 168 is suitably in a range of about 1 mm (0.04 in.) to about 12 mm (0.5 in.).

In this embodiment, shelves 150 are generally wedge-shaped to facilitate installation, for example, by allowing the magnets to be added with or without disassembly and reassembly of the product. In particular, shelves 150 have a minimum thickness 170 at a distal edge and a maximum thickness 172 at a proximal edge. For example, in some embodiments, shelves 150 have a maximum thickness 172 in a range of about 1.3 mm (0.05 in.) to about 5 mm (0.2 in.). In some embodiments, shelves 150 have a minimum thickness 170 in a range of about 0.25 mm (0.01 in.) to about 2.5 mm (0.1 in.). The thickness of shelves 150 varies at a constant rate from maximum thickness 172 to minimum thickness 170. In other embodiments, shelves 150 may have any shape that enables shelves 150 to function as described. For example, in some embodiments, shelves 150 may include planar surfaces, curves, and any other suitable shapes.

Each shelf 150 extends a shelf depth 174 from rear surface 160. Shelf depth 174 may be less than depth 158 to allow magnet assemblies (shown in FIG. 6) to fit within recesses 136. In some embodiments, shelf depth 174 is in a range of about 3 mm (0.125 in.) to about 19 mm (0.75 in.). In other embodiments, cleaning head 108 may include any shelves 150 that enable cleaning head 108 to operate as described.

Figure 6:
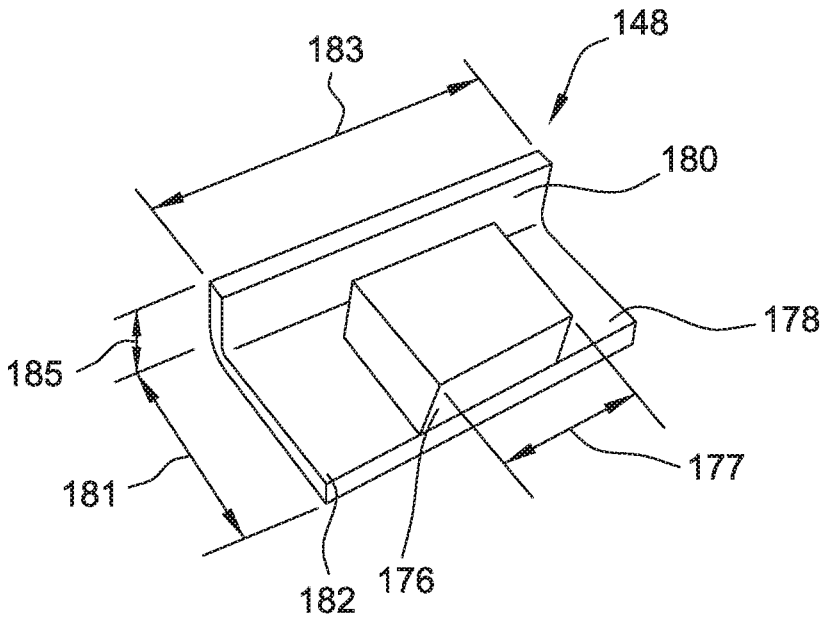
FIG. 6 is a perspective view of a magnet assembly that attaches to the cleaning head.
Figure 7:
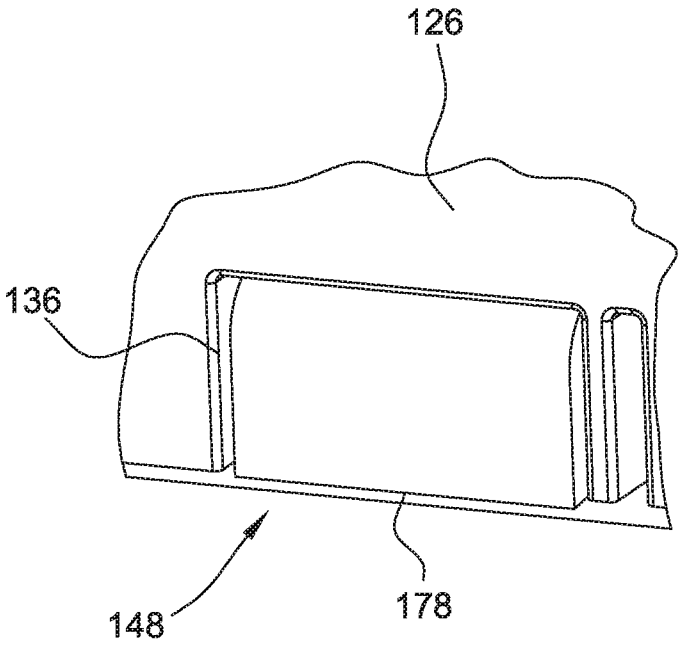
FIG. 7 is an enlarged perspective view of the magnet assembly positioned in the recess.

In reference to FIG. 6, each magnet assembly 148 includes a magnet 176 and a bracket 178. Bracket 178 includes a horizontal plate 180 and a vertical plate 182. Magnet 176 is connected to vertical plate 182. When magnet assemblies 148 are attached to front wall 126, horizontal plate 180 is supported on shelf 150 and magnet 176 is positioned below shelf 150. In other embodiments, vacuum cleaner 102 may include any magnet assembly 148 that enables vacuum cleaner 102 to operate as described.

Bracket 178 has a height 181, a length 183, and a depth 185. For example, in some embodiments, height 181 is in a range of about 6 mm (0.25 in.) to about 25 mm (1 in.). Length 183 is in a range of about 9.5 mm (0.375 in.) to about 102 mm (4 in.). Depth 185 is in a range of about 2.5 mm (0.1 in.) to about 19 mm (0.75 in.). In this embodiment, depth 185 is defined by horizontal plate 180 and height 181 is defined by vertical plate 182. Horizontal plate 180 and vertical plate 182 define length 183 and are joined along longitudinal edges to form an angle. In this embodiment, horizontal plate 180 and vertical plate 182 are perpendicular to one another.

Brackets 178 may include, for example and without limitation, plastics, metals, and any other suitable materials. For example, in some embodiments, brackets 178 are constructed of a ferromagnetic material, such as steel, and direct the magnetic field of magnet 176. In other embodiments, magnet assemblies 148 may include any brackets 178 that enable magnet assemblies 148 to function as described. For example, in some embodiments, brackets 178 are constructed of non-ferromagnetic materials, in addition to or as an alternative to ferromagnetic materials. In some embodiments, for example, ferromagnetic materials may be used to orient the magnetic fields of magnets 176, and non-ferromagnetic materials may be used to retain the magnets in position.

Each magnet 176 is attached to a rear surface of vertical plate 182 and is spaced from horizontal plate 180. Accordingly, shelf 150 may extend between magnet 176 and vertical plate 182 when magnet assembly 148 is attached to front wall 126. In this embodiment, magnet 176 is smaller than bracket 178. In particular, magnet 176 is generally square and has a length 177 that is less than length 183 of bracket 178. In some embodiments, length 177 is in a range of about 5 mm (0.2 in.) to about 25 mm (1 in.). As a result, magnet assembly 148 may be easier to position in recess 136. Moreover, in this embodiment, magnet 176 is centered along length 183 and substantially flush with a bottom edge of bracket 178. In other embodiments, magnet assembly 148 may include any magnet 176 that enables magnet assembly 148 to function as described. For example, in some embodiments, more than one magnet 176 may be connected to bracket 178.

In reference to FIG. 8, magnet assemblies 148 are positioned in recesses 136 such that horizontal plate 180 is above shelf 150 and magnet 176 is below shelf 150. Horizontal plate 180 is moved along the sloped surface of shelf 150 and shelf 150 guides horizontal plate 180 between shelf 150 and upper surface 164. The space between shelf 150 and upper surface 164 is greater than a thickness of horizontal plate 180 to allow horizontal plate 180 to move along shelf 150 without resistance. Accordingly, the magnet assemblies 148 are suitably sized to have a slip fit within recesses 136. In other embodiments, magnet assemblies 148 may be secured to cleaning head 108 in any manner that enables vacuum cleaner 102 to operate as described herein. For example, shelf 150 may provide an interference fit with magnet assemblies 148.

When magnet assemblies 148 are positioned in recesses 136, vertical plate 182 may contact shelf 150 and horizontal plate 180 does not necessarily contact rear surface 160. Accordingly, the depth of magnet assemblies 148 does not control the position of magnet assemblies 148 in recesses 136. In other embodiments, magnet assemblies 148 may be positioned in recesses 136 in any manner that enables magnet assemblies 148 to function as described.

Referring now to FIGS. 1 and 3, in this embodiment, the magnetic fields of magnets 176 are directed outwards from front wall 126 through bumper 152 when magnet assemblies 148 are attached to cleaning head 108. In particular, the magnetization direction of magnets 176 is perpendicular to a front surface of magnets 176. As a result, magnetic and magnetizable objects, such as metals, may be retained against bumper 152 prior to such objects entering cleaning head 108. In other embodiments, magnet assemblies 148 may have any magnetic fields that enable vacuum cleaner 102 to operate as described. For example, the magnetic field may encompass an area under cleaning head 108 such that magnetic and magnetizable objects under cleaning head 108 are attracted to magnet assemblies 148. In some embodiments, the magnetization direction is not perpendicular to the front surface of magnets 176. For example, the magnetization direction may be angled towards debris on a floor.

As shown in FIG. 3, in this embodiment, magnet assemblies 148 are separate from each other to allow individual removal and placement of magnet assemblies 148. In some embodiments, at least some recesses 136 may be empty. In further embodiments, different magnet assemblies 148, such as magnet assemblies 148 with different magnetic fields, may be positioned in recesses 136.

Compared to conventional vacuum cleaning systems, the vacuum cleaning systems of embodiments of the present disclosure have several advantages. For example, embodiments of the upright vacuum cleaner include magnet assemblies that prevent magnetized and/or magnetizable materials from entering a cleaning head and being drawn into a debris tube. Accordingly, the magnet assemblies prevent damage to components of the vacuum cleaner and prevent the objects from being propelled into the surrounding environment by the vacuum cleaner. In addition, the magnet assemblies are removably secured to shelves within recesses in a front wall of the cleaning head. Accordingly, the time required to assemble and maintain the vacuum cleaner is reduced. In addition, the magnet assemblies do not change the effective cleaning distance from the wall. Moreover, the magnet assemblies are hidden and do not affect the aesthetic appearance of the vacuum cleaner.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. An upright vacuum cleaner comprising:

a blower for pulling air and debris through the upright vacuum cleaner;

a motor connected to the blower;

a cleaning head for removing the debris from a floor, the cleaning head including a front wall, a rear wall, a first sidewall, and a second sidewall, the first sidewall and the second sidewall extending between the front wall and rear wall;

a debris tube connected to the cleaning head for receiving the debris from the cleaning head; and magnet assemblies adapted to prevent metal objects from entering the cleaning head, each magnet assembly including a bracket and a magnet, the bracket including a horizontal plate and a vertical plate, the magnet being connected to the vertical plate, wherein the front wall includes shelves to support the magnet assemblies, each shelf arranged to receive one of the magnet assemblies such that the horizontal plate rests on the shelf and the magnet is positioned below the shelf.

2. The upright vacuum cleaner of claim 1, wherein the front wall defines recesses to receive the magnet assemblies, each shelf disposed within a respective recess.

3. The upright vacuum cleaner of claim 2, wherein each shelf is wedge-shaped.

4. The upright vacuum cleaner of claim 2 further comprising a bumper extending along the front wall and covering the recesses.

5. The upright vacuum cleaner of claim 2, wherein each recess is defined by an upper surface, a rear surface, and side surfaces.

6. The upright vacuum cleaner of claim 5, wherein each shelf extends from the respective rear surface and is spaced from the respective upper surface.

7. The upright vacuum cleaner of claim 1, wherein the magnet has a length that is less than a length of the bracket.

8. The upright vacuum cleaner of claim 1, wherein the magnet and the horizontal plate define a space therebetween to receive the shelf.

9. The upright vacuum cleaner of claim 1, wherein the horizontal plate and the vertical plate are joined along longitudinal edges.

10. The upright vacuum cleaner of claim 9, wherein the horizontal plate is perpendicular to the vertical plate.

11. The upright vacuum cleaner of claim 1, wherein the magnet assemblies are separate to allow individual removal of each magnet assembly from the cleaning head.

12. The upright vacuum cleaner of claim 1 further comprising a rotary brush for agitating debris, the rotary brush being positioned in the cleaning head between the first sidewall and the second sidewall, wherein the magnet assemblies prevent metal objects from contacting the rotary brush.

13. The upright vacuum cleaner of claim 1, wherein the magnetic assemblies are positioned such that magnetic fields of the magnets are directed outwards from the front wall, the magnets being configured to retain metal objects against the cleaning head.

14. The upright vacuum cleaner of claim 13, wherein the magnetic assemblies are positioned such that a magnetization direction of the magnets is perpendicular to the front wall.

15. The upright vacuum cleaner of claim 1, wherein the brackets include a ferromagnetic material configured to direct magnetic fields of the magnets.

16. A method of assembling a vacuum cleaner including magnet assemblies, the method comprising:

removing a bumper from a front wall of a cleaning head of the vacuum cleaner to expose recesses in the front wall;

positioning each of the magnet assemblies in a respective one of the recesses, each magnet assembly including a bracket and a magnet, the bracket including a horizontal plate and a vertical plate, the magnet being connected to the vertical plate;

positioning the horizontal plate of each magnet assembly on a shelf within the respective recess, each shelf arranged to receive one of the magnet assemblies such that the horizontal plate rests on the shelf and the magnet is positioned below the shelf; and attaching the bumper to the front wall such that the bumper covers the recesses.

17. The method of claim 16, wherein each recess is defined by an upper surface, a rear surface, and side surfaces, each shelf extending from the respective rear surface and being spaced from the upper surface, the method further comprising positioning each horizontal plate between the respective upper surface and the respective shelf.

18. The method of claim 16, wherein each shelf is wedge-shaped, the method further comprising moving the horizontal plate of each magnet assembly along the respective shelf such that the shelf guides the magnet assembly into the recess.

19. The method of claim 16, wherein positioning each of the magnet assemblies in a respective one of the recesses comprises positioning each of the magnet assemblies such that the respective shelf is received in a space between the magnet and the horizontal plate.

20. The method of claim 16, wherein positioning each of the magnet assemblies in a respective one of the recesses comprises positioning each of the magnetic assemblies such that magnetic fields of the magnets are directed outwards from the front wall, wherein the magnets are configured to retain metal objects against the bumper.

* * * * *